US006565320B1

(12) United States Patent
Surls et al.

(10) Patent No.: US 6,565,320 B1
(45) Date of Patent: May 20, 2003

(54) MOLDED COOLING FAN

(75) Inventors: Michael M. Surls, Indianapolis, IN (US); Jonathan B. Stagg, Greencastle, IN (US)

(73) Assignee: BorgWarner, Inc., Auburn Hills, MI (US)

( * ) Notice: Subject to any disclaimer, the term of this patent is extended or adjusted under 35 U.S.C. 154(b) by 22 days.

(21) Appl. No.: 09/711,735

(22) Filed: Nov. 13, 2000

(51) Int. Cl.[7] ..... F01D 1/24
(52) U.S. Cl. ..... 416/175; 416/203
(58) Field of Search ..... 416/175, 203, 416/193 R, 243, 223 R, 236 R, 236 A, DIG. 2

(56) References Cited

U.S. PATENT DOCUMENTS 2,460,902 A * 2/1949 Odor ..... 170/159
3,885,888 A * 5/1975 Warhol ..... 416/175
4,150,301 A * 4/1979 Bergey, Jr. ..... 290/44
4,169,693 A * 10/1979 Brubaker ..... 416/93 R
4,746,271 A 5/1988 Wright
5,209,642 A * 5/1993 Larimer et al. ..... 416/223 R
5,437,541 A * 8/1995 Vainrub ..... 416/223 R
5,971,709 A * 10/1999 Hauser ..... 416/175
6,010,305 A 1/2000 Hauser
6,065,936 A * 5/2000 Shingai et al. ..... 416/175
6,375,427 B1 * 4/2002 Williams et al. ..... 419/169 A

* cited by examiner

*Primary Examiner*—Edward K. Look
*Assistant Examiner*—James M McAleenan
(74) *Attorney, Agent, or Firm*—Artz & Artz, P.C.; Greg Dziegielewski, Esq.

(57) ABSTRACT

A cooling fan (10) includes a plurality of blades (12) molded about a central hub plate (11) at an annular molded ring (13). A plurality of helical gussets (30) are formed on inlet side (25) of the molded ring (13) at the blade root (15) that are spaced apart to define flow gaps (32) therebetween, and are curved to substantially follow the airflow path through those gaps (32). A like plurality of radial ribs (40) may be formed at the outlet side (26) of the fan (10) that can include an indented stacking surface (41) that engages a contact surface (42) on the inlet side (25) to facilitate stacking of multiple fans. In another aspect, the fan blades (10) are configured to include elliptical or parabolic camber lines (C) that vary along the radial length of the blade so that the blade stacking, or the centers of gravity (CG) of radial blade segments, achieve a predetermined alignment under normal operating loads to minimize bending moments between blade sections.

12 Claims, 5 Drawing Sheets

BACK

MOLDED COOLING FAN

BACKGROUND OF THE INVENTION

The present invention concerns cooling fans, such as fans driven by and for use in cooling an industrial or automotive engine. More particularly the invention relates to features for improving the strength and flow characteristics of automotive cooling fans.

In most industrial and automotive engine applications, an engine-driven cooling fan is utilized to blow air across a cooling system, such as a radiator. Usually the fan is driven by a belt-drive mechanism connected to the engine crankshaft.

A typical cooling fan includes a plurality of blades mounted to a central hub plate. The hub plate can be configured to provide a rotary connection to the belt-drive mechanism, for example. The size and number of fan blades is determined by the cooling requirements for the particular application. For instance, a small automotive fan may only require four blades having a diameter of 18 inches. In larger applications, a greater number of blades and a greater fan diameter may be required. In one typical heavy-duty automotive application, nine blades are included having an outer diameter of 704 mm.

In addition to the number and diameter of blades, the cooling. capacity of a particular fan is governed by the airflow volume and static efficiency that can be generated at an operating speed. Airflow volume and efficiency are dependent upon the particular blade geometry, such as blade area and blade curvature, as well as the rotational speed of the fan. Larger fan blades usually lead to greater airflow rates. Moreover, curved blades are generally more efficient than flat blades.

As the cooling fan airflow capacity increases, the loads experienced by the fan, and particularly by the blades, also increase. Increased airflow through the fan can lead to higher bending moments acting on the blades, and ultimately to increased bending stresses between blade sections. Perhaps most significantly, the higher fan speeds and flow rates can increase the stress experienced by each fan blade.

These problems become particularly acute for one-piece molded cooling fans. In order to reduce weight, most new industrial and automotive cooling systems employ fans formed of a high-strength moldable polymer material. Typically, this polymer material is injection molded about the hub plate, which is usually metallic. Weight and cost considerations frequently drive the design of such molded cooling fans, most specifically to reduce the amount of material contained within the fan. In addition, the fan configuration is typically constrained by the desire to produce the fan using only two mold halves, without the need for movable inserts.

Thus, a constant engineering tension exists between fans designed for weight and cost reduction and those designed for strength and airflow capacity. As the desire for high speed, high flow, lightweight fans increases, the design requirements for these fans become much more strenuous. The present invention provides for one solution to these apparently opposing design forces.

SUMMARY OF THE INVENTION

The present invention concerns a molded cooling fan having a plurality of blades integrated with a molded ring about a central hub plate. The plate is preferably metallic and provides means for connecting the fan to a source of rotary power. The fan can be formed using conventional molding techniques, such as injection molding. Moreover, the fan can be formed of conventional moldable materials, such as a high-strength polymer.

In one feature of the invention, the molded components of the fan have a substantially uniform thickness throughout. In other words, the molded ring and blades have substantially the same thickness. The exception to this uniformity is adjacent the blade roots, where the blade thickness is increased for strength purposes. Moreover, this uniform thickness is less than is found in the typical prior art fan. In one specific embodiment, the nominal thickness is about 3.0 mm.

In order to maintain the strength characteristics of the fan, another feature of the invention contemplates the addition of helical gussets at the molded ring on the inlet side of the fan. These gussets are in the form of a thin-walled angled fin, having its greatest height at blade root adjacent the trailing edge of each blade, and decreasing in height to the inner diameter of the molded ring. In order to prevent any disruption of the airflow across the front side of the blades, the gussets are curved and arranged in a helical pattern about the circumference of the molded ring. The gussets define airflow channels between each other, and are curved to substantially follow the effective airflow path through these channels. In certain embodiments, the airflow channels are further defined by support webs defined between the root of each blade and the molded ring.

In certain embodiments, a strengthening feature is added to the back or outlet side of the fan. In these embodiments, a number of radial ribs are integrally formed with the molded ring. A rib preferably starts at the junction of the trailing edge of each blade with the molded ring and continues to the inner diameter of the ring. The rib further has the same uniform thickness as the remainder of the molded components of the fan. A circumferential support web can be formed between the rib and the outer diameter of the molded ring. The rib and support web can combine to provide additional strength at the blade root, particularly for high pitch blades.

In another aspect of the invention, the radial ribs provide a feature to enhance the stackability of the inventive fan. More specifically, the top of the radial rib defines an inset stacking surface. This stacking surface engages a contact surface on the inlet side of the fan. The inset aspect of the stacking surface allows adjacent fans to nest within each other. The depth of the inset stacking surface determines the degree of overlap of the adjacent fans, and ultimately the reduction in stack height for a quantity of fans.

In order to accommodate the helical gussets in certain fan embodiments, the radial ribs define a clearance region that is cut out at the location of the gusset. Finally, each rib can then include a radially angled strengthening web between the clearance region and the molded ring.

The thin-walled blade construction of the present invention can create blade strength problems under maximum operating conditions. As the fan rotates, the blades are subject to inertial loads that tend to de-pitch the blades and, more critically, to generate significant stresses at the blade root and along blade sections. The present invention contemplates a blade design that addresses these problems. In one aspect of the design, the blades have an elliptical or a parabolic camber line defining the curvature from the leading edge to the trailing edge. The elliptical or parabolic camber line is calculated based on such parameters as the inlet angle at the leading edge and the outlet angle at the trailing edge. Moreover, the blade is configured so that the maximum curvature of the camber line occurs adjacent the trailing edge.

In another aspect of the invention, the blade stacking line is configured so that the centers of gravity of blade sections along its radial length are positioned to greatly reduce or eliminate bending stresses under normal operating conditions. In prior blade designs, the center of gravity at each blade section is aligned along the length of the blade under static, or non-loaded, conditions. As the fan spins up to speed, the aerodynamic loads bend the blades due to the pressure differential across the fan inlet and outlet, causing the centers of gravity to fall out of alignment. As a result, a mean bending stress is generated along the blade length that is a function of the resulting moment occurring along the blade. The maximum stress experienced by each blade is the superposition of a cyclic or alternating operating stress on the total mean stress (i.e., a combination of bending and tensile stress). In accordance with the present invention, the blade centers of gravity fall into a predetermined stacking arrangement under the normal operating loads. This feature effectively eliminates the mean bending stress, and ultimately greatly reduces the maximum total stress value.

It is one important object of the present invention to provide a molded cooling fan having reduced material requirements, while still maintaining adequate strength characteristics. Another object is accomplished by providing design features that can be readily manufactured in conventional molding processes.

One benefit of the cooling fan according to the present invention is that it easily accounts for the effects on the fan blades running at a maximum operational speed. A further benefit is that certain features of the invention provide strength where it is needed with a minimum of added material.

Other objects and benefits of the invention can be discerned from the following written description and accompanying figures.

DESCRIPTION OF THE PREFERRED EMBODIMENTS

Figure 1:
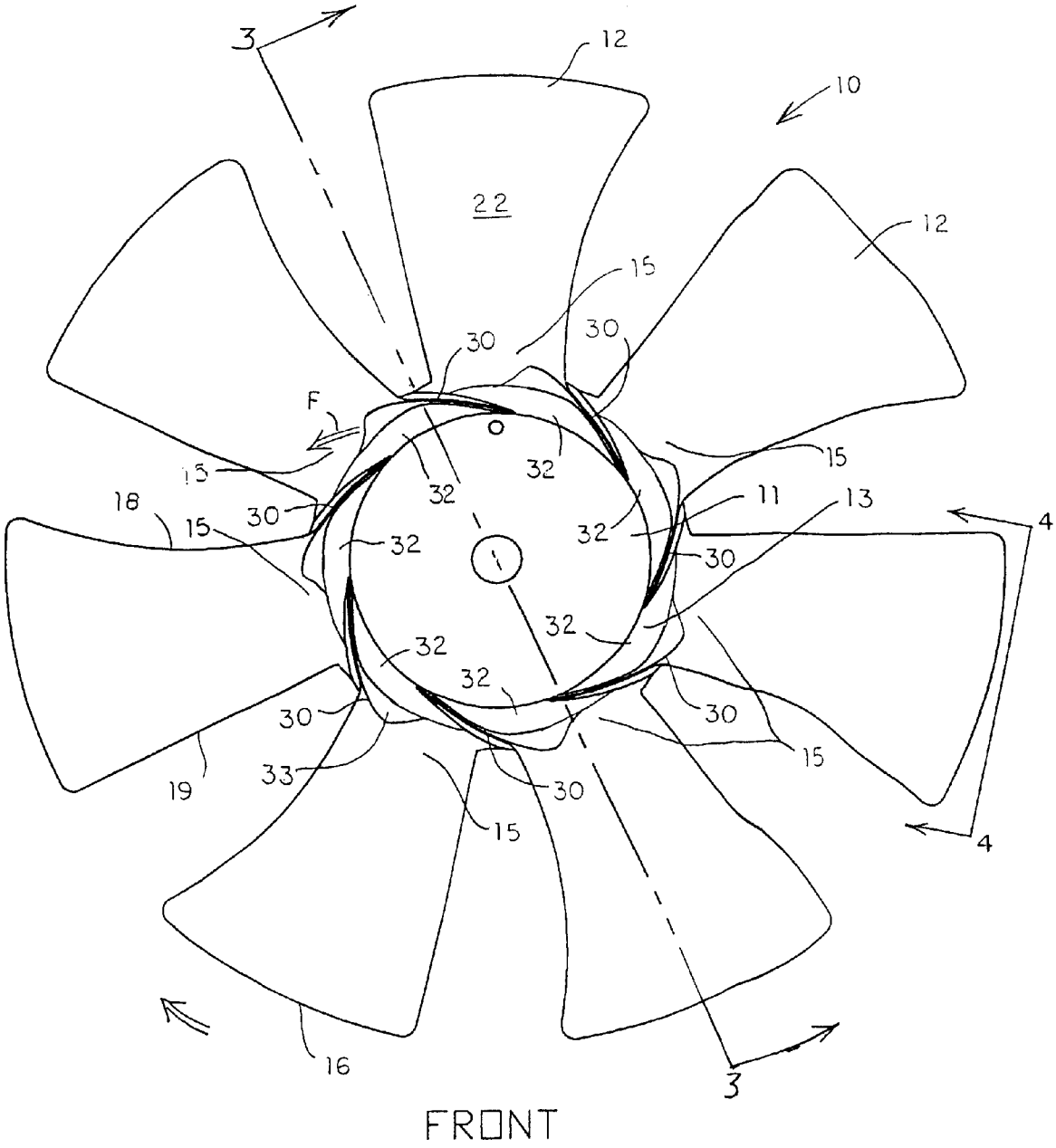
FIG. 1 is a top elevational view of the cooling fan according to one embodiment of the present invention.
Figure 2:
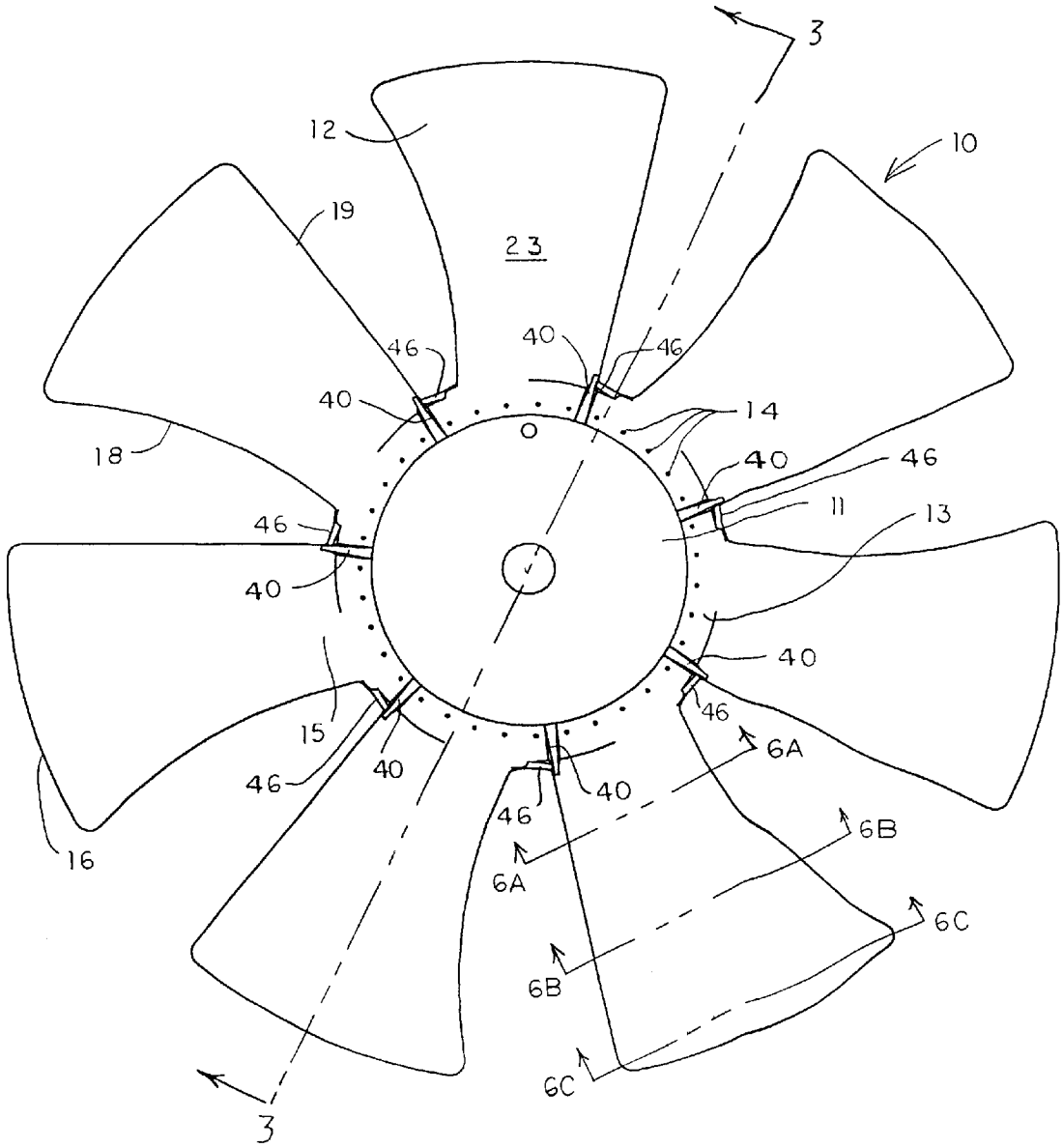
FIG. 2 is a bottom elevational view of the cooling fan shown in FIG. 2.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

The present invention contemplates a cooling fan 10 that is preferably configured for injection molding. The preferred material of the fan is a high-strength polymer. The fan 10 includes a hub plate 11 that is preferably metallic, such as light-weight aluminum. The hub plate 11 can be configured for rotational engagement to a rotary drive source. Typically this drive source is a belt-drive or transmission mechanism arranged to rotate the cooling fan at a high speed.

The fan 10 includes a plurality of blades 12 formed of the moldable polymer. In the illustrated embodiment, seven such blades are provided; of course, the number of blades is dictated by the cooling requirements of the particular industrial or automotive application. In one specific embodiment, the blades define an outer diameter of about 450.0 mm. Again, the overall size of the fan can be dictate d by the particular cooling requirements.

Each of the blades 12 is integrated with the hub plate 11 by way of a molded annular ring 13. Preferably the hub plate 11 defines a plurality of retention holes 14 therethrough, as best depicted in the cross-sectional view of FIG. 3. The polymer material of the molded ring 13 then flows through the retention holes 14, firmly engaging the molded portion of the fan 10 to the metallic hub plate 11.

As with any cooling fan, each of the blades 12 includes a blade root 15 integral with the molded ring 13, and an opposite blade tip 16. In the preferred embodiment, the blade tip is free or unsupported. Each of the blades also includes a leading edge 18 and a trailing edge 19, with the leading edge preceding the trailing edge as the fan rotates in its given direction of rotation. Each blade also includes a front face 22 and an opposite back face 23. The front face 22 corresponds to the inlet side 25 (see FIG. 3) of the fan 10 while the back face 23 coincides with the outlet side 26 of the fan. The configuration of the leading and trailing edges 18 and 19, respectively, can be of a variety of known configurations.

As thus far described, the fan 10 is similar to most known molded cooling fans. However, in accordance with one aspect of the invention, the overall thickness of the molded components of the fan—i.e., most particularly the blades 12 and molded ring 13—is kept as thin as possible. In addition, the thickness of each of the components is preferably uniform throughout the majority of the molded components of the fan. Thus, the molded ring 13 has a thickness, as measured from the hub plate 11, which is substantially the same as the thickness of the majority of each of the blades 12. In one preferred embodiment, this substantially uniform thickness is about 3.0 mm. Thus, the fan 10 of the present invention utilizes a minimum amount of polymer material, while still retaining the performance characteristics of known cooling fans.

However, with the reduced uniform thickness, the fan 10 is more susceptible to inertial and aerodynamic forces experienced by the fan blades 12 as the fan is run at its maximum operating speed. The aerodynamic loads exerted on the blades have a tendency to twist the blades, which results in significant stress at the junction between the blades and the 12 and the molded ring 13. One prior solution has been to increase the thickness of the fan at this interface region. However, this approach naturally increases the amount of material needed to make the fan. Moreover, the regions of increased thickness typically require some difficult modifications to the injection molds. Finally, simply applying material on the fan where the stress is the highest increases the fan mass, which has a tendency to increase the total stress value of the fan.

Thus, in accordance with one feature of the invention, the fan 10 includes a plurality of helical gussets 30 defined around the molded ring 13. Each of the gussets 30 is integrated into a corresponding blade 12 at the blade root 15. As shown best in FIG. 3, each gusset 30 includes an angled edge 31 that gradually decreases in height from the blade root 15 to the molded ring 13. In one important aspect, the gussets 30 are arranged in a helical pattern about the molded ring 13.

This pattern maintains a series of flow channels 32 between adjacent gussets. These flow channels accommodate additional airflow at the blade root 15, rather than interfering with that flow, as typically occurs when material is simply added to the blade root. Most particularly, the gussets 30 follow a curvature corresponding to the flow path F of air through each of the flow channels 32. The gussets essentially pull air from the center of the hub 11 to increase the airflow rate through the fan. In the specific embodiment depicted in FIG. 1, the gussets 30 draw upwards of 100 CFM through the flow channels 32.

Thus, with the gussets 30 of the present invention, the blade root 15 of each of the blades 12 is firmly supported against the aerodynamic moment experienced by the blade. The gussets 30 provide the added benefit that the blades 12 can be pitched fairly significantly relative to the molded ring 13. In the absence of the gussets, the blades would be forced to intersect the molded ring 13 at a shallower angle so that the stress experienced at the blade root 15 can be more easily dissipated through the ring. In contrast with the present invention, the aerodynamic moment experienced at the blade root 15 is reacted by the gussets 30. The helical arrangement of the gussets means that a significant amount of the aerodynamic moment is reacted by tension through the length of the gusset, rather than by a bending moment as would occur if the gussets were simply radially oriented on the molded ring 13.

The blades 12 of the cooling fan 10 of the preferred embodiment are significantly pitched relative to the molded ring 13, as previously indicated. The helical gussets 30 provide effective strength at the inlet side 25 of the fan 10. However, a significant portion of each blade 12 projects beyond the molded ring 13 at the outlet side 26 of the fan. In other words, the trailing edge 19 is offset a significant distance from the surface of the molded ring 13. This offset also requires some type of strengthening component. As described above, this strengthening can occur by simply adding more material at the interface between the blade root/trailing edge and the molded ring. Naturally, this approach is not optimum for the reasons set forth above.

Consequently, in accordance with a further feature of the invention, a plurality of radial ribs 40 are arranged around the molded ring 13. Each of the ribs 40 is integral with the blade root 15 of a corresponding blade. The ribs 40 are radially oriented, rather than helically, because airflow across the outlet side is not a significant factor in the airflow performance of the fan. Moreover and perhaps most significantly, the radial ribs 40 serve a "stacking" function—i.e., the ribs provide a means for stable stacking of a number of fans 10.

To achieve this stackability feature, each rib 40 includes a stacking surface 41 that is offset or indented from the trailing edge 19 of each blade. The radial rib 40 is arranged so that a contact surface 42 immediately adjacent the helical gusset 30 on the inlet side 25 of the fan, contacts the stacking surface 41. In order to achieve this stacking arrangement between the inset stacking surface 41 and the contact surface 42, each radial rib 40 includes a gusset clearance cutout portion 43 that provides clearance for a lower height part of the angled edge 31 of each helical gusset 30. The rib 40 further includes an angled strengthening rib 44 between the gusset clearance portion 43 and the molded ring 13. The strengthening rib 44 can be flared inwardly toward the inner diameter of the molded ring.

Further stiffness is provided at the outlet side 26 of the fan by a circumferential support web 46. The support web 46 is integral with the radial rib 40 and extends downward from the trailing edge 19 at the blade root 15 to the molded ring 13. Thus, the combination of the radial rib 40 and the support web 46 provides significant strength and support to the back face 23 of each of the blades 12. Moreover, the radial rib configuration enhances the stackability of the fan 10. The indented stacking surface 41 helps reduce the overall height of a quantity fans. In one specific embodiment, the inset stacking surface 41 is indented about 10.0 mm, which results in a reduction of stacking height equal to this indent dimension times the number of stacked fans. In addition, the inset stacking surface increases the stability of a stack of fans over prior fan designs.

Figure 3:
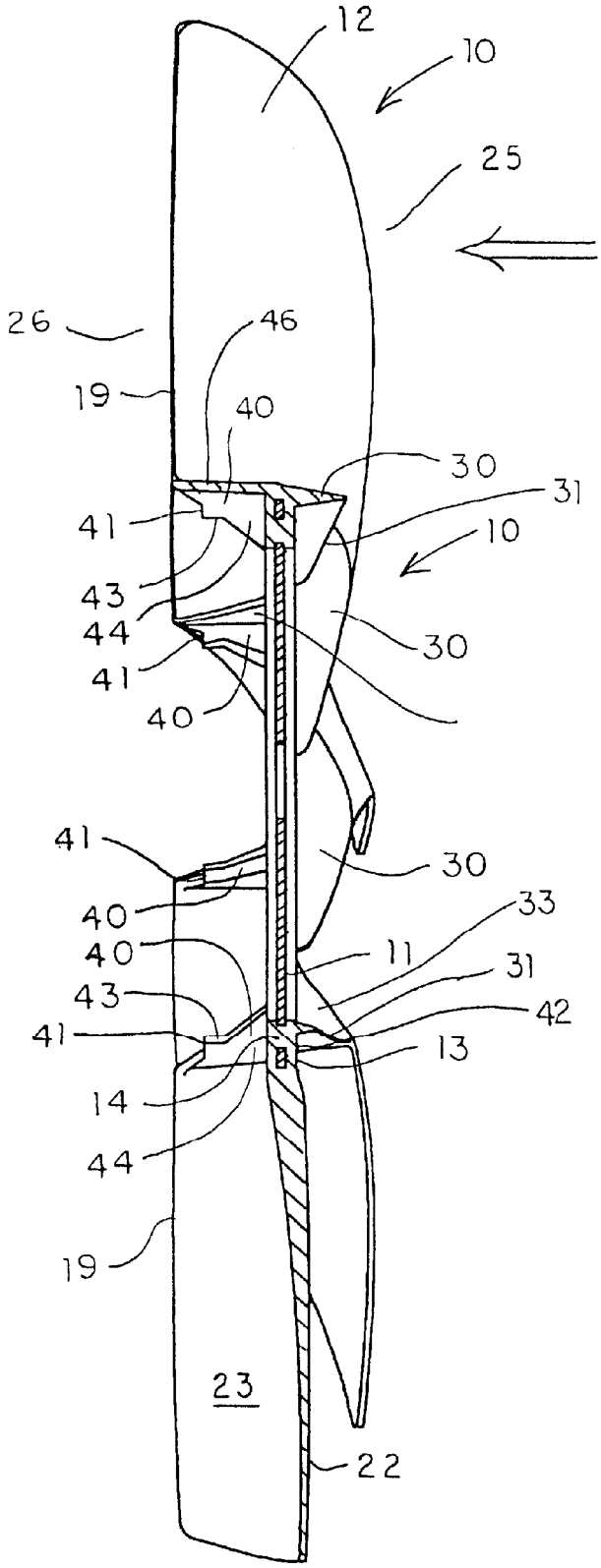
FIG. 3 is a side cross-sectional view of the cooling fan shown in FIGS. 1 and 2, taken along line 3—3 as viewed in the direction of the arrows.
Figure 4:
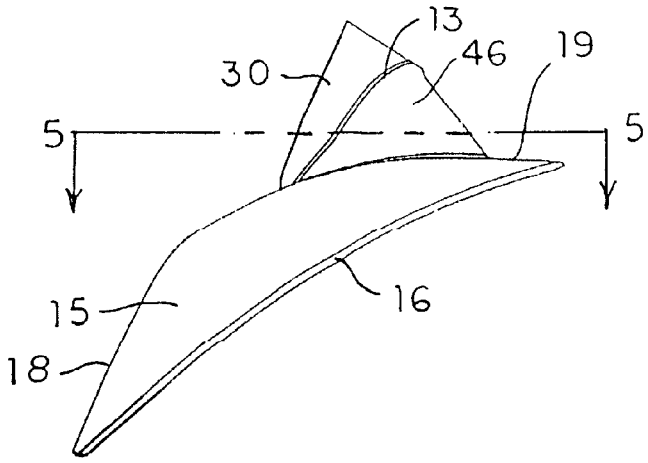
FIG. 4 is an end view of a blade of the fan depicted in FIG. 1, as taken along line 4—4 and viewed in the direction of the arrows.
Figure 5:
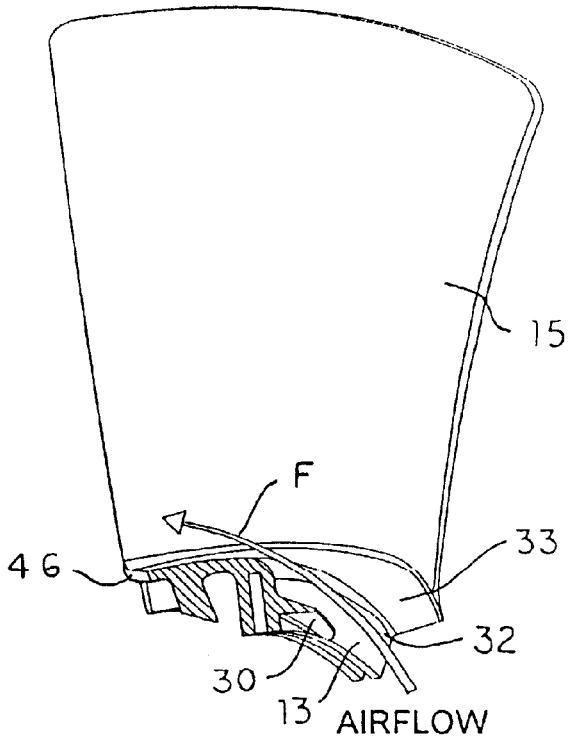
FIG. 5 is a partial cross-sectional view of the blade shown in FIG. 4, taken along line 5—5 as viewed in the direction of the arrows.

A further support web 33 can be provided between the blade root and the molded ring 13 on the inlet side of the fan, as shown best in FIGS. 1, 3 and 5. This web 33 is, in effect, an analog of the web 46 on the outlet side of the fan. However, as illustrated in FIG. 5, the support web 33 cooperates with the helical rib 30 to further define the airflow channel 32. The presence of the support web 33 prevents flow shedding at the blade root, which ultimately increases the airflow capacity of the fan.

Figure 6:
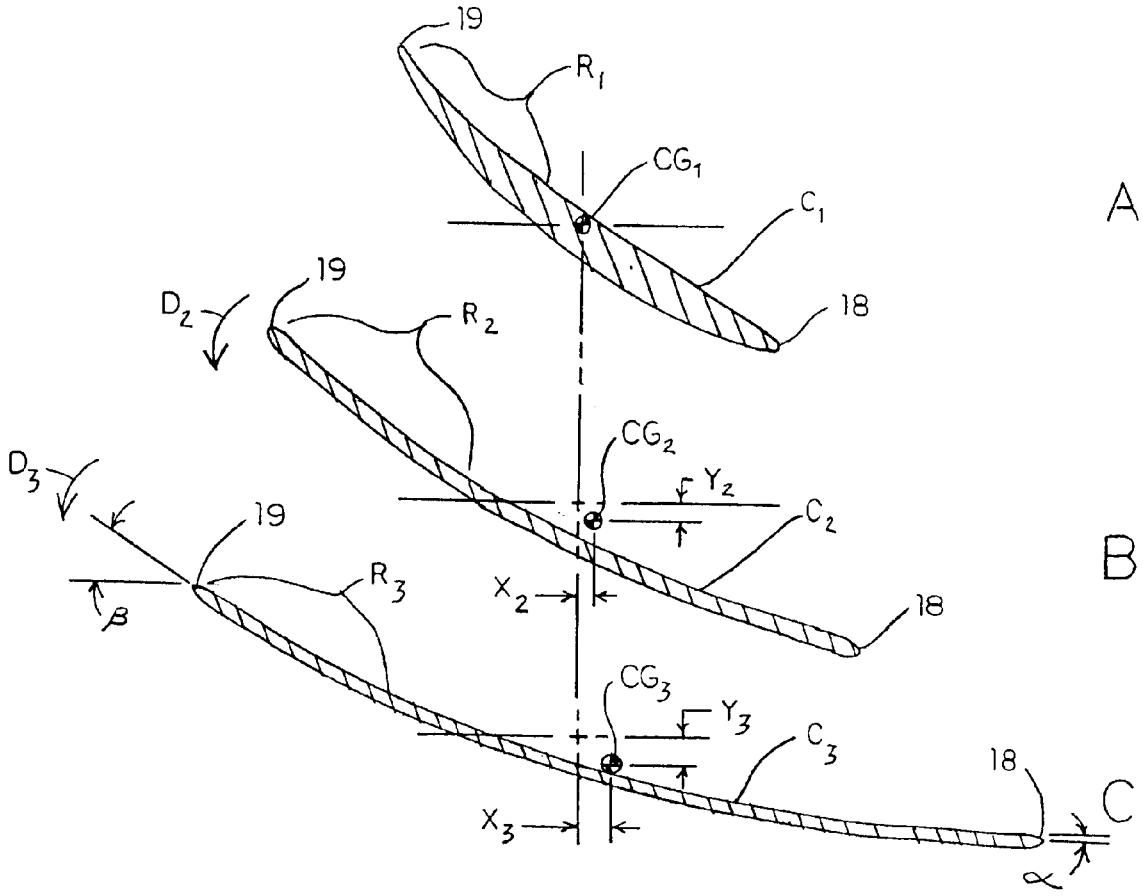
FIGS. 6A–C are a series of cross-sectional views of a blade of the fan shown in FIG. 2, taken along the lines 6*a*—6*a*, 6*b*—6*b*, 6*c*—6*c*, as viewed in the direction of the arrows.

Commensurate with the reduced material feature of the present invention comes a greater interest in the de-pitching of the fan blades 12. A cross-section at three radial locations along the blade is shown in FIG. 6. At the radial-most inboard position at line 6*a*—6*a*, the blade 12 has its greatest thickness. This thickness is fairly uniform between the blade mid-point and the blade tip 16 as evidence by the cross sections at 6*b*—6*b* and 6*c*—6*c*. Each blade 12 experiences a de-pitching moment that has a tendency to rotate the trailing edge 19 toward the outlet side 26 of the fan 10. This de-pitching moment is represented by the arrows $D_2$ and $D_3$ at the two outer-most blade cross sections 6*b*—6*b* and 6*c*—6*c*.

Figure 7:
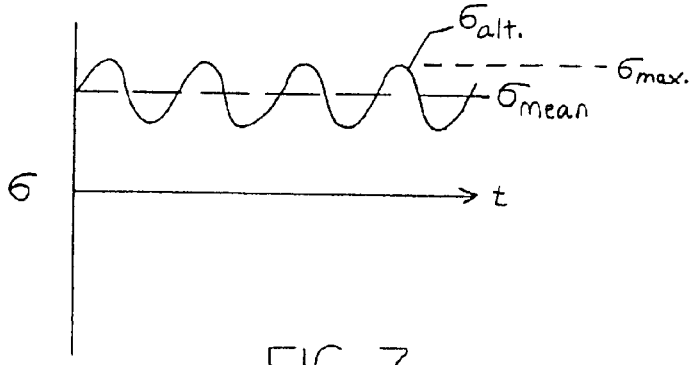
FIG. 7 is an idealized graph of blade stress under normal operating conditions.

This de-pitching phenomenon yields varying bending moments along the length of the blade. These bending moments are generally cyclic as the fan rotates at its operational speed. This cyclic loading leads to a cyclic stress experienced at each blade section that is a function of the difference in bending moment between sections. Frequently, the cyclic stress is particularly acute at the blade root 15. This cyclic stress is idealized in the graph shown in FIG. 7. More specifically, the cyclic stress includes a mean component ($\sigma_{mean}$) and an alternating component ($\sigma_{alt}$), in which the alternating component is superimposed on the mean stress. The mean stress component includes tensile and bending stresses generated by centrifugal effects on the fan blades.

In prior blade designs, each section along a blade from root to tip has an aligned center of gravity in the static, or un-loaded, position of the blade. However, as the fan spins up to speed, the center of gravity at each blade section shifts under centrifugal and aerodynamic loads. Since the present invention contemplates a fairly thin blade, the alternating stress $\sigma_{alt}$ is a performance characteristic that must be accepted as the blade inevitably experiences some oscillation, particularly in sectional bending stress. However, the present invention contemplates reducing the mean stress $\sigma_{mean}$ onto which an alternating stress $\sigma_{alt}$ is superimposed. In so doing, the maximum stress $\sigma_{max}$ experienced at the blade root can be significantly reduced. If the bending stress can be reduced to zero, then the tensile and alternating stress is all that would be experienced by the blade 12. In that case, the fan 10 can then handle higher alternating stress loads, or alternatively, an increased reserve factor can then be assigned to the particular fan.

In order to accomplish this beneficial feature, the present invention contemplates offsetting the centers of gravity at each blade section when taken at a static condition. More specifically, the blade stacking is calibrated to achieve minimal bending stresses along blade sections as the blade centers of gravity shift under normal loading.

Thus, as depicted in FIGS. 6*a*–6*c*, the center of gravity of the radially innermost segment 1 can establish a baseline orientation. In the next radially outboard segment 2, it can be seen that the center of gravity $cg_2$ is offset from that baseline position by values $X_2$ and $Y_2$. Finally, at the blade tip, as represented by the last segment 3, the third center gravity $Cg_3$ is offset by values $X_3$ and $Y_3$ that are greater than the corresponding offsets at the middle segment 2. The blade tip has a greater static center of gravity offset because it experiences the greatest amount of deflection under operating loads.

With these center of gravity offsets, once the fan 10 is running at its operational speed, the blade stacking, or more particularly the centers of gravity along adjacent sections, achieves an alignment that minimizes the bending moments between blade sections. In other words, each of the offset values $X_2$, $Y_2$, $X_3$ and $Y_3$ become predetermined values. Under these ideal conditions, the bending stress experienced by each blade 12 can be reduced substantially to zero.

The present invention provides a further feature that takes advantage of inertial and aerodynamic moments $D_2$ and $D_3$ experienced by the fan blades. In traditional blade design, each blade section follows a substantially circular arc. However, under the normal operation loads, this arc tends to flatten due to centrifugal or inertial forces exerted on each blade. In order to overcome this problem, the present invention contemplates blade cross-sections that have elliptical or parabolic camber lines. This parabolic segment is configured to achieve a predetermined inlet angle $\alpha$ at the blade leading edge 18, and an exit angle $\beta$ at the blade trailing edge 19. The form of the parabola is such that the blade has its greatest curvature at the regions $R_1$, $R_2$, $R_3$ immediately adjacent the trailing edge 19 of the blade.

One specific equation for the blade 12 as depicted in FIG. 6 can have the following form:

$$Ax^2+Bxy+Cy^2+Dx+Ey+F=0$$

In accordance with the present invention, the specific parabolic equation at each radial blade segment is different from the next. As a consequence, the centers of gravity of each of the blade sections will achieve an optimal stacking under normal loading, as explained above.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A cooling fan (10) comprising:

a central hub plate (11) configured for engagement to a source of rotary power;

an annular ring (13) molded about said central hub plate;

a plurality of blades (12) having a free blade tip (16) and a blade root (15) integral with said annular ring, each of said blades including a leading edge (18) and a trailing edge (19); and a plurality of helical gussets (30) defined on said annular ring between said blade root of a corresponding one of said blades and an inner diameter of said annular ring, wherein each of said helical gussets originate at said leading edge of said corresponding blade.

2. The cooling fan according to claim 1, wherein said helical gussets have a height from said annular ring that decreases from said blade root to said inner diameter.

3. The cooling fan according to claim 1, in which the fan defines an inlet side (25) and an outlet side (26), wherein said helical gussets are defined at the inlet side of the fan.

4. The cooling fan according to claim 3, further comprising a plurality of radial ribs (40) defined on said annular ring at the outlet side of the fan.

5. The cooling fan according to claim 4, wherein said radial ribs extend from an inner diameter of said annular ring to said blade root.

6. The cooling fan according to claim 4, wherein said radial ribs extend from said trailing edge of a corresponding one of said blades.

7. A cooling fan (10) comprising:

a central hub plate (11) configured for engagement to a source of rotary power;

an annular ring (13) molded about said hub plate;

a plurality of blades (12) having a free blade tip (16) and a blade root (15) integral with said annular ring, each of said blades including a leading edge (18) and a trailing edge (19), the cooling fan according to claim 1, wherein said blades follow a horizontal parabolic curve (C) between said leading and trailing edges.

8. The cooling fan according to claim 7, wherein said parabolic curve changes along a radial length of each of said blades.

9. The cooling fan according to claim 7, wherein said parabolic curve has a region (R) of greatest curvature, said region being adjacent said trailing edge of each of said blades.

10. A cooling fan (10) comprising:

a central hub plate (11) configured for engagement to a source of rotary power;

an annular ring (13) molded about said hub plate; and a plurality of radial blades (12) having a free blade tip (16) and a blade root (15) integral with said annular ring, each of said blades including a leading edge (18) and a trailing edge (19), each of said blades having a curvature (C) between said leading and trailing edges that varies along a radial length of each of said blades, wherein each of said blades defines centers of gravity (CG) at blade segments along said radial length of said blades, said centers of gravity being offset relative to each other; and a plurality of helical gussets (30) defined on said ring between a blade root of a corresponding one of said blades and an inner diameter of said annular ring, wherein each of said helical gusts originate at said leading edge of said corresponding blade.

11. The cooling fan according to claim 10, wherein said centers of gravity are offset relative to each other when the fan is in a static condition.

12. The cooling fan according to claim 10, wherein said curvature of each of said blades is configured so that said centers of gravity align along said radial length of each of said blades when the fan is in a loaded condition.

* * * * *